United States Patent [19]

Martin et al.

[11] 4,198,993

[45] Apr. 22, 1980

[54] COMBINATION SMOKING AND DRINKING ARTICLE

[76] Inventors: Jerome E. Martin; Beverley J. Martin, both of 5540 Muckland Ave., Red Creek, N.Y. 13143; Charles J. Emering, 220 S. Roselle Rd., Apt. 407, Schaumburg, Ill. 60172

[21] Appl. No.: 895,268

[22] Filed: Apr. 10, 1978

[51] Int. Cl.[2] ..... A24F 1/30

[52] U.S. Cl. ..... 131/173; 131/196; 215/12 R

[58] Field of Search ..... 131/173, 196, 194; 215/12, 13; D27/2, 3, 4

[56] References Cited

U.S. PATENT DOCUMENTS

| | | | |
|---|---|---|---|
| 1,244,410 | 10/1917 | Barnby | 131/196 |
| 2,805,670 | 9/1957 | Wang | 131/173 |
| 3,755,030 | 8/1973 | Doman et al. | 215/12 R |

*Primary Examiner*—Stephen C. Pellegrino

[57] ABSTRACT

An article that serves the dual function of a smoking pipe and drinking receptacle, and thereby permits the concurrent smoking of tobacco and consumption of a beverage through use of a single instrument. The article has the general configuration of a mug, comprising an inner shell that forms a reservoir for holding a beverage and a surrounding outer shell having smoke input and output means, a smoke chamber normally containing a smoke filtering agent being provided between the inner and outer shells to accommodate the travel of smoke between said input and output means. The smoke chamber is securely sealed from the reservoir to prevent contamination of the beverage by the smoke or filtering agent, while the inner shell serves to conduct heat between the chamber and reservoir to provide auxiliary cooling of the smoke.

9 Claims, 7 Drawing Figures

COMBINATION SMOKING AND DRINKING ARTICLE

BACKGROUND OF THE INVENTION

The invention pertains generally to the field of hand held articles used for such purposes as tobacco smoking and beverage consumption. More specifically, the invention relates to water smoking pipe devices, and the like, and to drinking mug devices. Should it be the desire of a person to engage in pipe smoking and beverage consumption during the same period of time, two separate articles must be employed, namely, a pipe of suitable construction and a drinking mug or similar device. Since water pipes may be relatively large and unwieldy devices, such activity normally requires the repeated lifting and setting down of the pipe and drinking device during their use. This is not only inconvenient but also necessitates care to avoid jarring or upsetting either of the devices in the process of their repeated handling.

SUMMARY OF THE INVENTION

It is accordingly an object of the invention to provide a novel hand held article that can serve the dual function of a smoking pipe and drinking receptacle.

It is a further objection of the invention to provide a novel article as described that has means for containing a quantity of water or other filtering agent to filter and cool the smoke during the course of its travel through the article.

It is another object of the invention to provide a novel article as described which includes means for accomplishing an auxiliary cooling of the smoke that enhances the cooling action of the filtering agent.

These and other objects are accomplished in accordance with one aspect of the invention by a novel hand held article in the general configuration of a mug, comprising an inner shell that forms a reservoir for holding a beverage to be consumed and a surrounding outer shell having associated therewith at least smoke input means and smoke output means, each coupled to an enclosed smoke chamber formed between said inner shell and said outer shell to accommodate the travel of smoke from said input means to said output means. Said smoke chamber is capable of holding a smoke filtering agent, such as potable water, for filtering and cooling the smoke in the course of its travel, said article being constructed so that the smoke chamber is sealed from the reservoir in order to prevent contamination of said beverage by said smoke or smoke filtering agent. Said inner shell has a heat conductive wall which serves to conduct heat between the smoke chamber and reservoir for providing auxiliary cooling of the smoke.

In accordance with a further aspect of the invention, the smoke input means comprises a first opening in said outer shell and a first tubular member, one end of which extends through said opening into said smoke chamber and the other end of which is coupled to a bowl for holding smoking material, and the smoke output means comprises a second opening in said outer shell and a second tubular member, one of which extends through said second opening into said smoke chamber and the other end of which is coupled to a mouthpiece. A first portion of the smoke chamber is adapted to contain the smoke filtering agent, said first tubular member penetrating said filtering agent and said second tubular member being located with its one end within a second portion of said smoke chamber that is remote from the portion containing said filtering agent.

In accordance with a further aspect of the invention, said outer shell comprises a third opening for admitting air to said smoke chamber for enhancing the smoking process, and a fourth opening through which said filtering agent can be supplied to and evacuated from said smoke chamber.

BRIEF DESCRIPTION OF THE DRAWINGS

While the specification concludes with the claims which particularly point out and distinctly define that subject matter which is regarded as the invention, it is believed the invention will be more clearly understood when considering the following detailed description taken in connection with the accompanying figures of the drawing, in which:

DESCRIPTION OF THE PREFERRED EMBODIMENTS

Figure 1:
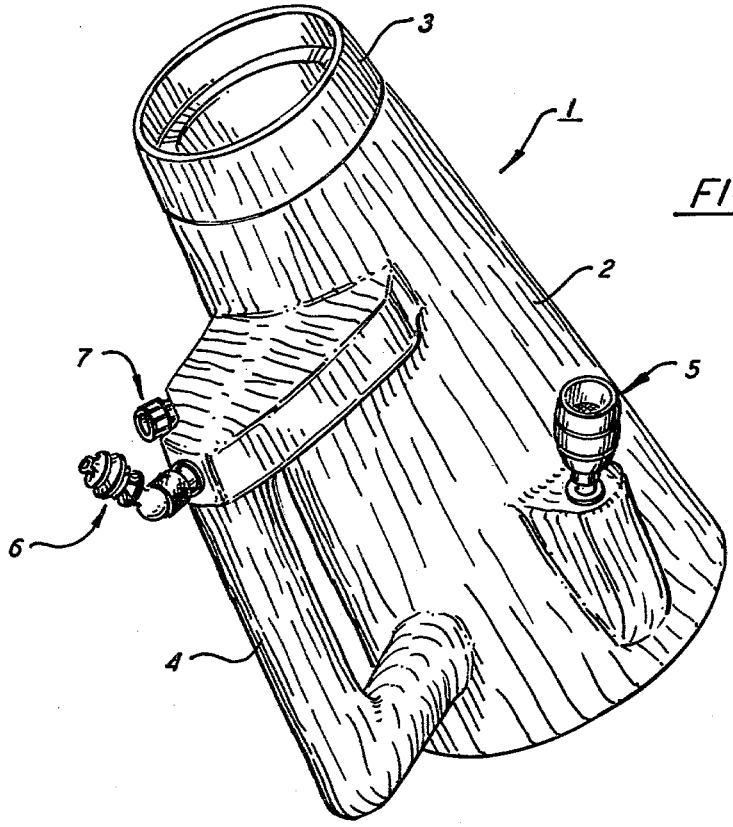
FIG. 1 is a perspective view of a combination smoking and drinking article, in accordance with the invention.
Figure 3:
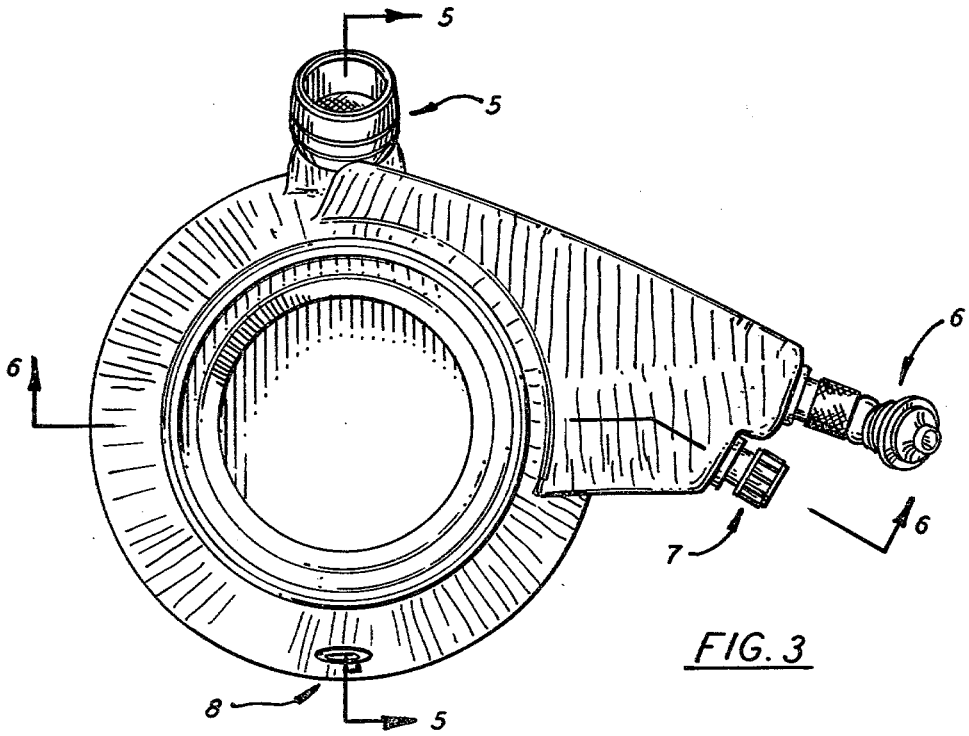
FIG. 3 is a plan view of the inventive article.
Figure 2:
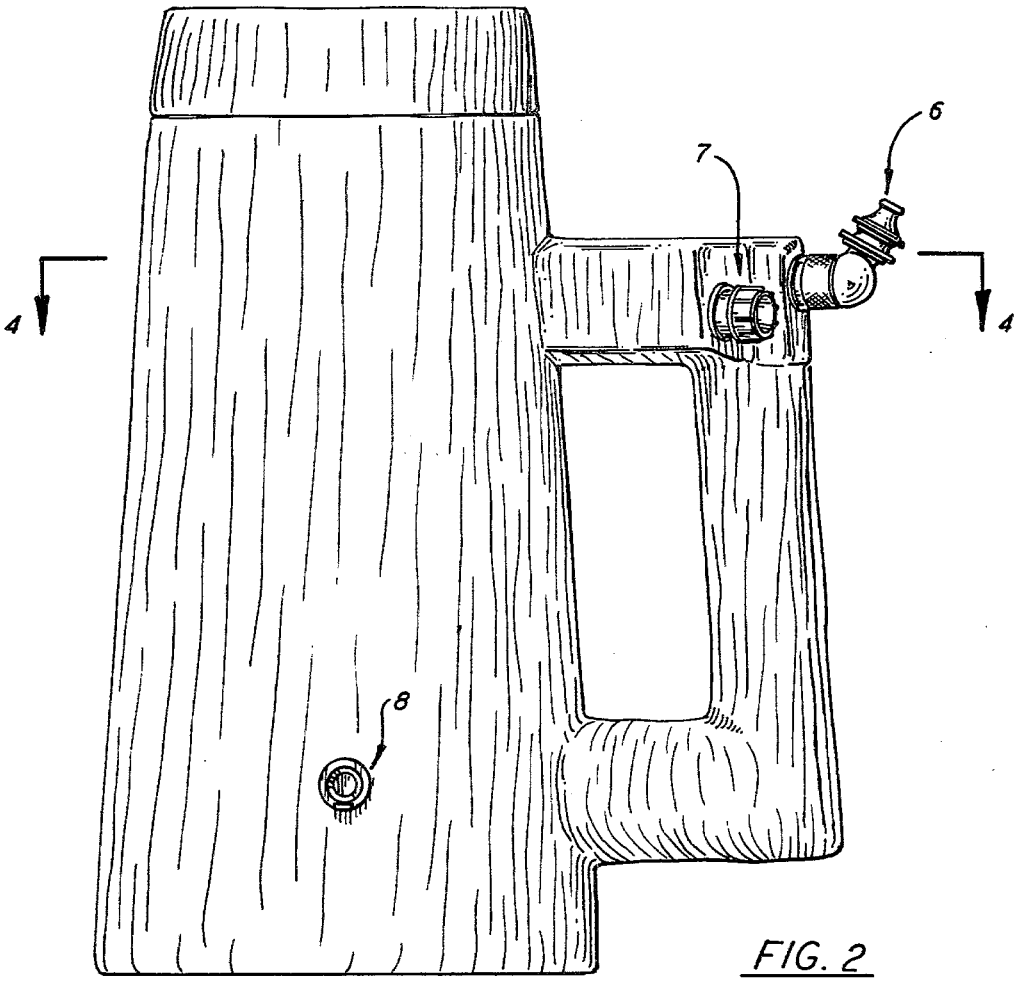
FIG. 2 is an elevational view of the inventive article.

Referring to FIG. 1, there is illustrated, in perspective view, a combination smoking and drinking article 1 in accordance with the invention. The article 1 is in the general configuration of a mug and serves the dual function of a drinking receptacle and smoking pipe to thereby permit the smoking of tobacco and consumption of a beverage during the same period of time. The article includes an outer shell of generally circular cross-section that is tapered toward the top and an inner shell 3, only the top portion of which appears in FIG. 1. The outer shell includes a handle 4 for holding the article and further has associated therewith a pipe bowl attachment 5, a mouthpiece attachment 6, an air inlet attachment 7 and a smoke filtering agent fill port 8. The latter element is shown in the elevational view of FIG. 2 and the plan view of FIG. 3, which two views show the external features of article 1 with additional clarity.

The inner shell 3 has a main body portion that is generally cylindrically shaped and closed at the bottom end, and a wider, open ended top portion that is tapered to mate with outer shell 2. The inner shell which is more clearly shown in the cross-sectional views of FIGS. 5 and 6, forms a reservoir for holding the beverage 9 to be consumed. The inner shell seats on the outer shell at the joint 10. A smoke chamber 11 is provided between the inner and outer shells, a portion of which is adapted to contain a smoke filtering agent 12, most commonly water, which filters and cools the smoke during the smoking process. In the embodiment being considered, the smoke chamber 11 extends into the hollow handle 4. However, for purposes of the invention the handle could be of solid construction and therefore not be a part of the smoke chamber. The inner and outer shells are adhered together at the mating surfaces 10 in the construction under consideration, although the two shells could be formed as single unit. In any case the construction must provide for a secure seal between the reservoir and the smoke chamber so as to ensure the contents of each cannot mix to any degree. Further, the wall of the inner shell acts to conduct heat between the smoke chamber and the reservoir so as to provide an auxiliary cooling action of the smoke when a cold beverage is contained in the reservoir.

Figure 5:
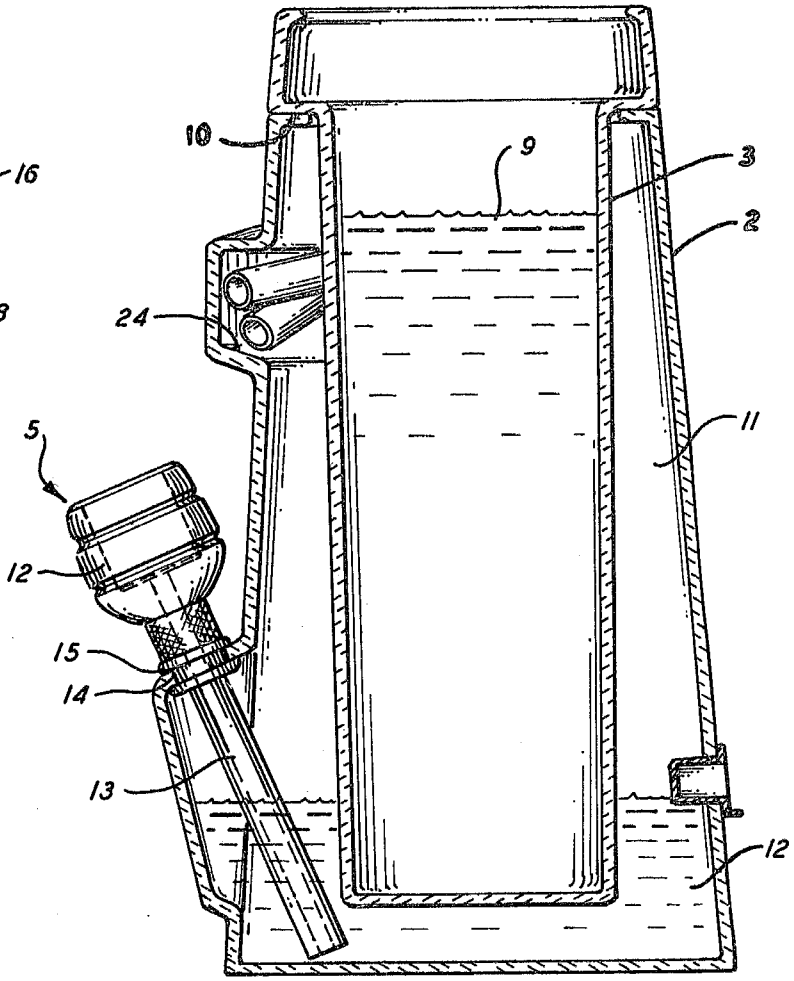
FIG. 5 is a cross-sectional view of the inventive article taken along the line 5—5 in FIG. 3.

The pipe bowl attachment 5 includes a pipe bowl 20 that couples to a pipe bowl tube 13 which is fitted within an opening 14 in the outer shell, as shown in FIG. 5. The bowl 5 typically has a threaded male stem that is screwed to the threaded female end of the tube 13. The tube is sufficiently long to penetrate the water 12, preferably reaching close to the bottom of the outer shell so as to provide a maximum filtering action. A grommet 15 provides a water tight seal around the tube 13.

Figure 4:
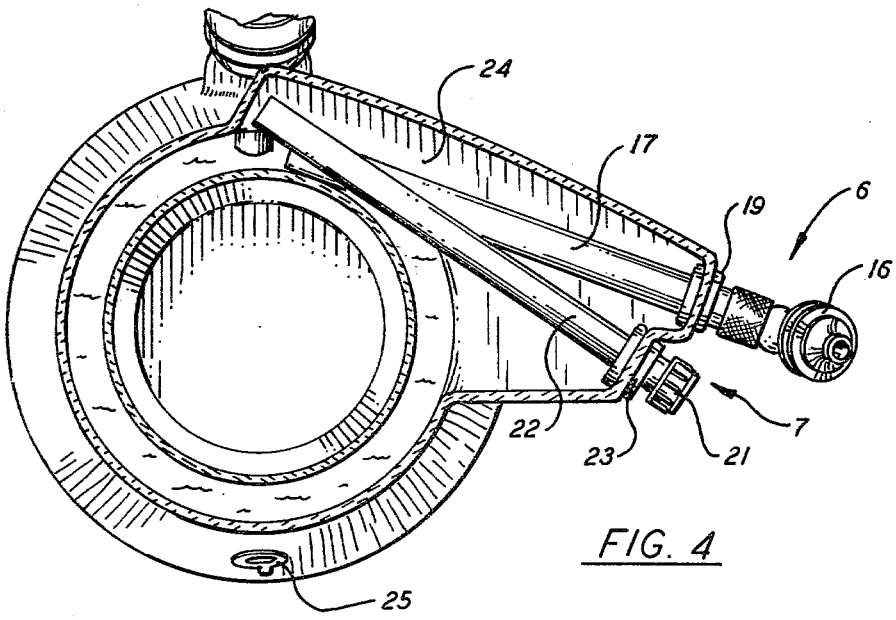
FIG. 4 is a cross-sectional view of the inventive article taken along the line 4—4 in FIG. 2.
Figure 6:
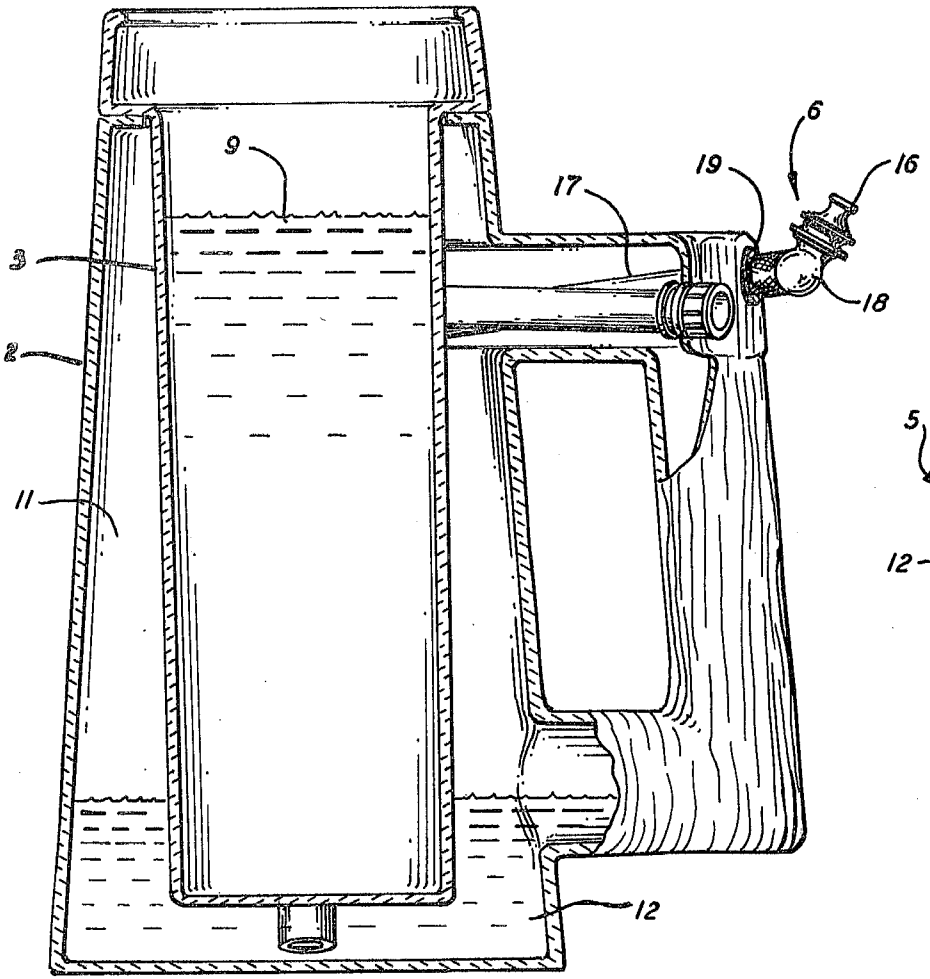
FIG. 6 is a cross-sectional view of the inventive article taken along the line 6—6 in FIG. 3.

As best shown in the cross-sectional views of FIGS. 4 and 6, the mouthpiece attachment 6 includes a mouthpiece 16 coupled to a mouthpiece tube 17 that extends through an opening in the upper region of the handle 4. The mouthpiece 16 has typically a threaded male stem that is screw fitted to the tube 17 through a ball coupling member 18, a grommet 19 providing a water tight seal around the tube. The tube 17 extends into the handle 4 with its free end located within the smoke chamber 11 so as to be in approximately vertical alignment with the pipe bowl attachment 5, for reasons to be further explained.

The air inlet attachment 7 includes an annular end member 21 that may be screw coupled to an air inlet tube 22 which extends through an opening also in the upper region of the handle 4, a grommet 23 providing a water tight seal around the tube. The tube 22 is adjacent tube 17 and also has its free end located within the smoke chamber in an approximate vertical alignment with the bowl attachment 5. The mouthpiece tube 17 is conveniently supported by a shelf 24 formed on the inside wall of the outer shell, with the tube 22 resting on it. The fill port 8 comprises an opening in the wall of the outer shell sealed by a readily removable plastic cap 25 through which the smoke filtering agent is readily supplied to and evacuated from the smoke chamber.

In the embodiment of the invention under consideration, the body of the article 1, consisting of the inner and outer shells, is composed of a non-porous, lead free clay ceramic material. However, for purposes of the invention numerous other "food safe" materials could be employed, both organic and inorganic, including glass, porcelein, pewter, wood and numerous plastic materials. The various tubes, couplings and the mouthpiece are conveniently made of metal, but might be of other suitable materials such as plastic. The pipe bowl is wood, but alternatively may be of metal or ceramic. The filtering agent is potable water, but might be charcoal or other nontoxic material suitable for filtering smoke.

The significant dimensions of the present embodiment are as follows: for the outer shell 2, outside bottom diameter 4½ inches, outside top diameter 3⅜ inches, height 7½ inches, and wall thickness ⅛ inch; for the inner shell 3, outside bottom diameter 2½ inches, outside top diameter 3⅛ inches, height 7¾ inches, and wall thickness ⅛ inch. The overall height is 8½ inches. These dimensions are given for purposes of completing the disclosure and are in no way limiting of the invention.

When considering the article 1 as made of ceramic, a conventional fabrication process is employed in which the outer shell and inner shell are first formed separately and then combined into an integral unit. A pair of mold halves are used, one pair for each shell. With the mold halves fitted tightly together, the starting material of clay emulsified in water, known as slip, is poured into the molds and allowed to set until the desired thickness of clay forms on the side of the molds, in this case ⅛ inch. The excess slip is then poured out, the molds pulled apart and the clay forms, or greenware, are aged for several hours. The two shells, as the greenware, are then fired in a kiln at cone 06 for about 6 hours and subsequently cooled for about 6 hours to obtain a product known as bisqueware. The bisqueware is then coated with a suitable glaze. The inner shell is placed inside of the outer shell and seated thereon as illustrated in the figures, and the unit fired in a kiln for about 3 hours and cooled for about the same length of time. The fired glaze acts to provide a nonporous, smooth finish to the article and to firmly adhere the inner and outer shells together.

In using the invention, the reservoir formed by the inner shell 3 may be filled with a beverage. The water filtering agent 12 is introduced through the fill port 8 so as to occupy the lower portion of the smoke chamber 11. Although a greater volume of water will contribute to contribute to correspondingly greater filtering action, it is important not to fill the smoke chamber with an excessive amount of filtering agent in order to avoid back up of the agent through the free end openings of the mouthpiece and air inlet tubes 17 and 22. In the embodiment being considered, the water is at a level just below the fill port, having a depth of about 1¼ inches. Thus, for the indicated construction and dimensions, the article can be tilted by more than 90° for completely emptying the reservoir, without the filtering agent approaching the region of the tube openings. Back up is also guarded against by proper placement of the mouthpiece and air inlet tubes. Since during beverage consumption, the article is intended to be tilted away from the pipe bowl, i.e., about an axis parallel to the line 4—4 in FIG. 2 with the top moving out of the plane of the paper, optimum location for the free end openings of the two tubes, in addition to being in the upper portion of the smoke chamber, is in a vertical alignment with the pipe bowl attachment 5. However, locating the openings on the same side of the smoke chamber within an arc of up to 90° to either side of said vertical alignment will effectively avoid any back up provided the volume of filtering agent is not excessive and the tilt angle is generally as indicated.

In the smoking process, drawing on the mouthpiece pulls smoke from the pipe bowl 20, through the pipe bowl tube 13, through the water filtering agent 12 and through the smoke chamber 11 to the mouthpiece tube 17. The filtering agent serves to filter and cool the smoke as it travels through the agent. The wall of the inner shell 3 conducts heat from the smoke chamber to the beverage contained in the reservoir for providing an auxiliary cooling of the smoke. It may be appreciated that the article can be utilized without using a smoke filtering agent, in which case the contents of the reservoir act as the primary smoke cooling agent.

The art inlet port may be readily closed during drawing of smoke by placing the thumb over the opening in end member 21. Periodically the air inlet port may be allowed to remain open to admit fresh air to the smoke chamber which mixes with the smoke to enhance and improve efficiency of the smoking operation. The air inlet port is of itself a conventional feature and may be of a different configuration than that described or entirely omitted from the present article without diminishing the invention to any extent.

Furthermore, the mouthpiece and air inlet tubes 17 and 22 function principally to effectively locate the free end openings to the mouthpiece and air inlet port in a portion of the chamber that remains clear of the filtering agent at all times and particularly when the article is tilted, while allowing the mouthpiece and an inlet port to be placed in the most convenient location. However, for purposes of the invention, these tubes can be of different length and shape than illustrated, or may be eliminated entirely by locating the mouthpiece and air inlet ports closer to a vertical alignment with the pipe bowl attachment. Correspondingly, the pipe bowl tube can be of different length than illustrated, or eliminated entirely by providing a different arrangement between the pipe bowl and the outer shell. For example, the pipe bowl might be provided with an L shaped stem that directly entered an opening adjacent to the bottom of the outer shell.

Figure 7:
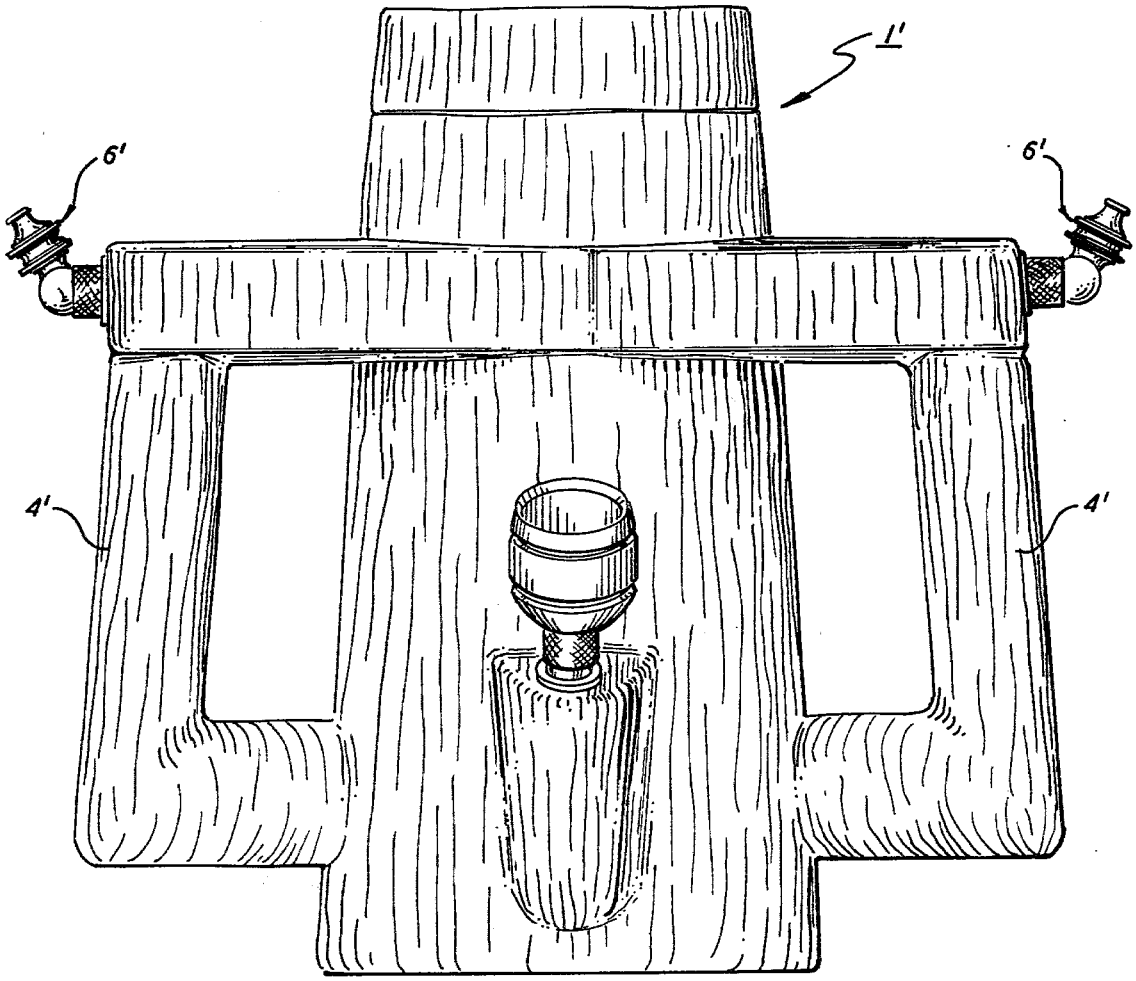
FIG. 7 is an elevational view of a combination smoking and drinking article, in accordance with a second embodiment of the invention.

Although the combination smoking and drinking article thus far considered has a single mouthpiece attachment, it can have a plurality of similar attachments within the concept of the present invention to permit smoking participation by more than a single person. In providing plural mouthpiece attachments they should be arranged with their openings in the smoke chamber within an arc of no greater than 90° to either side of the pipe bowl in order to avoid possible back up of the filter agent into the mouthpieces. As an example of such alternative embodiment, there is illustrated in FIG. 7 an elevational view of a smoking and drinking article $1^1$ which corresponds to the article described in the preceding figures but which has two handles $4^1$, one the mirror image of the other, and two mouthpiece attachments $6^1$. In this embodiment, the free end openings of the mouthpiece tubes will both be in an approximately vertical alignment with the pipe bowl attachment $5^1$, in accordance with the single mouthpiece tube illustration of FIG. 4. The air inlet attachments, which would be behind the mouthpiece attachments and do not show in FIG. 7, can be fitted with a normally closed air valve that is readily opened by finger operation when desired to evacuate the smoke chamber. Alternatively a single normally open air inlet attachment can be provided in the region where the handles $4^1$ are joined, in which case the air inlet tube will be shortened or eliminated.

Although the invention has been described with respect to specific embodiments thereof for the purpose of a clear and complete disclosure, it may be appreciated that numerous changes and modifications can be made to the described structure by ones skilled in the art without departing from the true scope and spirit of the present invention, which is not to be limited except as defined by the appended claims.

What is claimed as new and desired to be secured by Letters Patent of the United States is:

1. A combination smoking and drinking article, comprising:

(a) a first shell member forming a reservoir for holding a beverage, (b) a second shell member intimately interfacing with said first shell member, said first and second shell members forming an enclosed smoke chamber that is securely sealed from said reservoir, (c) smoke input means associated with said second shell member and coupled to said smoke chamber, (d) smoke output means associated with said second shell member and coupled to said smoke chamber, said smoke chamber acting to accommodate the travel of smoke between said smoke input means and said smoke output means, and (e) said first shell member including a heat conducting wall for conducting heat between said smoke chamber and said reservoir for providing a cooling action for said smoke.

2. A combination smoking and drinking article as in claim 1 wherein a first portion of said smoke chamber is adapted to contain a smoke filtering agent, said smoke input means being coupled to said first portion of said smoke chamber and said smoke output means being coupled to a second portion of said smoke chamber that is sufficiently removed from said first portion so as to avoid back up of said filtering agent through said smoke output means when said article is in a normal upright position and when said article is tilted for pouring said beverage.

3. A combination smoking and drinking article as in claim 2 wherein said smoke input means includes a first opening in said second shell member and a first tubular member one end of which extends through said first opening into said first portion of said smoke chamber, and said smoke output means includes a second opening in said second shell member and a second tubular member one end of which extends through said second opening and into said second portion of said smoke chamber.

4. A combination smoking and drinking article as in claim 3 in which said one end of the first tubular member and said one end of the second tubular member are vertically displaced from one another on one side of said smoke chamber, whereby there is avoided any back up of said filtering agent through said smoke output means when said article is in a normal upright position and when said article is tilted away from said one side for pouring said beverage.

5. A combination article as in claim 4 which includes a plurality of smoke output means.

6. A combination smoking and drinking article as in claim 5 in which said first shell member is an inner shell and said second shell member is an outer shell and associated with said outer shell are air inlet means for selectively admitting air to said smoke chamber.

7. A combination smoking and drinking article as in claim 6 in which associated with said outer shell are fill port means through which said smoke filtering agent may be supplied to and evacuated from said smoke chamber.

8. A combination smoking and drinking article as in claim 7 wherein said inner and outer shells are made of a ceramic material.

9. A combination smoking and drinking article, comprising:

(a) an inner shell member of generally cylindrical shape having a closed bottom end and an open top end, said inner shell forming a reservoir for holding a beverage, (b) an outer shell member including a handle and having a closed bottom end and tapered sides which substantially surround said inner shell member so as to form an enclosed smoke chamber that is securely sealed from said reservoir, the lower portion of said smoke chamber being adapted to contain a smoke filtering agent, (c) a fill port associated with said outer shell member through which said smoke filtering agent may be supplied to and evacuated from said smoke chamber, (d) said inner shell member including a heat conducting wall for conducting heat between said smoke chamber and said reservoir for providing an auxiliary cooling action for said smoke, (e) a pipe bowl attachment including a pipe bowl connected to a first tube that extends through a first opening in said outer shell member, the free end of said first tube being located within the lower portion of said smoke chamber and penetrating said smoke filtering agent, (f) a mouthpiece attachment including a mouthpiece connected to a second tube that extends through a second opening in the upper region of said handle, (g) an air inlet port including an annular end member connected to a third tube that extends through a third opening in the upper region of said handle adjacent to said second opening, and (h) a shelf formed on the inside wall of said outer shell member for supporting said second and third tubes with their free ends located within the upper portion of said smoke chamber and on one side thereof in approximate vertical alignment with the free end of said first tube, whereby there is avoided any back up of said filtering agent through said mouthpiece attachment or said air inlet port when said article is in a normal upright position and when said article is tilted away from said one side for pouring said beverage.

* * * * *